United States Patent [19]

Matlin et al.

[11] 4,452,045

[45] Jun. 5, 1984

[54] SMOOTHING ELECTRICAL ENERGY OUTPUT WITH MECHANICAL ACCUMULATOR

[75] Inventors: Ronald W. Matlin; Alan R. Millner; Frederick W. Sarles, all of Lexington, Mass.

[73] Assignee: TriSolarCorp., Bedford, Mass.

[21] Appl. No.: 256,731

[22] Filed: Apr. 23, 1981

[51] Int. Cl.[3] ..... F03G 7/02

[52] U.S. Cl. ..... 60/641.8; 60/652; 290/1 R; 417/410

[58] Field of Search ..... 60/641.8, 659, 652; 417/410; 74/41; 136/206; 290/1 R

[56] References Cited

U.S. PATENT DOCUMENTS

| | | | |
|---|---|---|---|
| 1,948,288 | 2/1934 | Corey | 74/41 |
| 4,033,134 | 7/1977 | Bentley | 60/641.8 |
| 4,309,148 | 1/1982 | O'Hare | 417/209 X |
| 4,321,837 | 3/1982 | Grigsby | 74/41 |
| 4,370,559 | 1/1983 | Langley, Jr. | 290/1 R |

*Primary Examiner*—Allen M. Ostrager
*Assistant Examiner*—Stephen F. Husar

[57] ABSTRACT

Coupling a solar array to a device with fluctuating power requirements through a mechanical energy accumulator to smooth power demand.

5 Claims, 6 Drawing Figures

SMOOTHING ELECTRICAL ENERGY OUTPUT WITH MECHANICAL ACCUMULATOR

FIELD OF THE INVENTION

Figure 1:
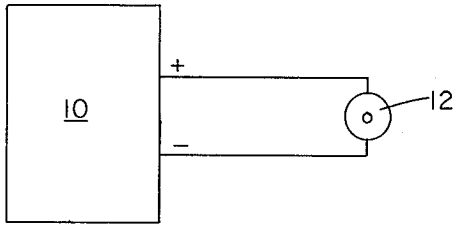

This invention relates to driving devices with fluctuating power requirements, for example, jack pumps, using solar arrays which produce under constant sun conditions a constant maximum power output.

BACKGROUND OF THE INVENTION

The prior art is familiar with arrangements in which a substantially constant-maximum-power-output solar array is matched to, for example, a jack pump through a battery, which charges and discharges to match the constant-output array to the device of fluctuating power requirements. It is also known in prior art, as in Kelley U.S. Pat. No. 3,917,213, to halve peak loads by counterbalancing, so that each complete cycle is characterized by two peaks of half of what would otherwise be the peak size.

SUMMARY OF THE INVENTION

It has been discovered that an array of the character described may be usefully, effectively, reliably, and relatively inexpensively coupled to a device of fluctuating power requirements through a mechanical accumulator, such as a weight, a fly wheel, a spring, or gas compression, to smooth power demand.

PREFERRED EMBODIMENTS

We turn now to preferred embodiments of the invention.

DRAWINGS

There is shown in the drawings two said preferred embodiments.

In FIG. 1 is shown a diagrammatic view of the overall combination.

Figure 2:
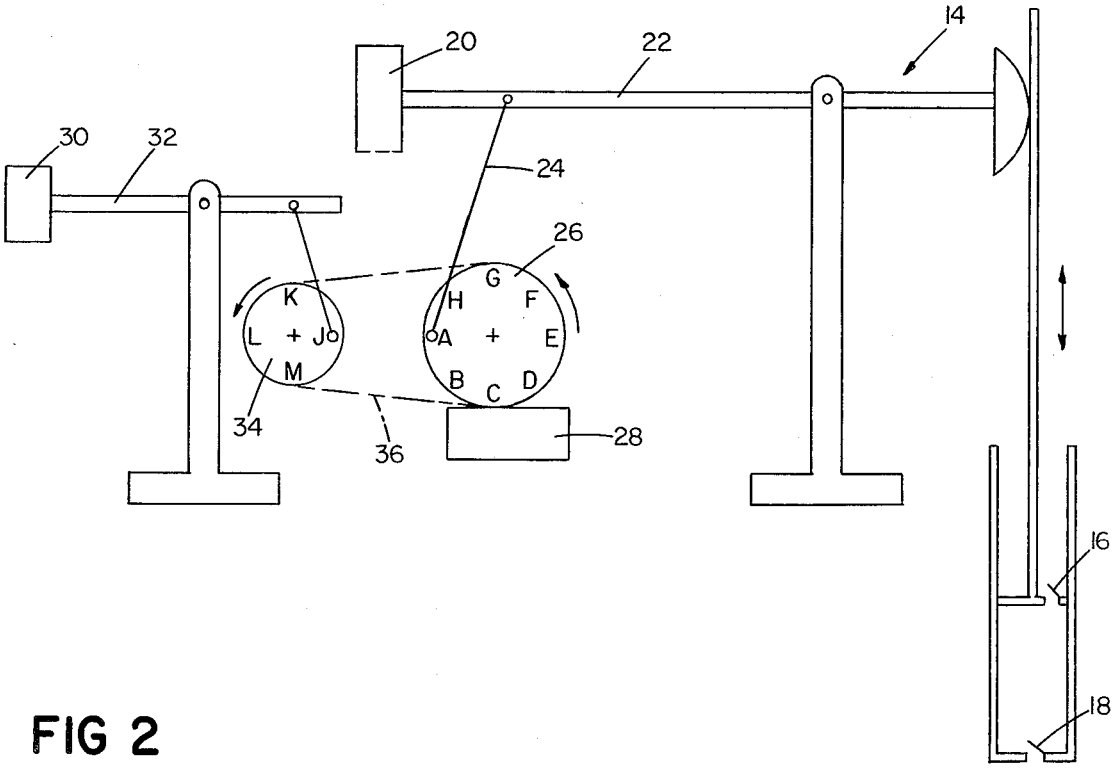

In FIG. 2 is shown the most preferred embodiment.

Figure 2A:
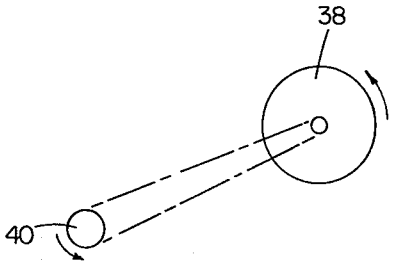

In FIG. 2A is shown another preferred embodiment.

Figure 3:
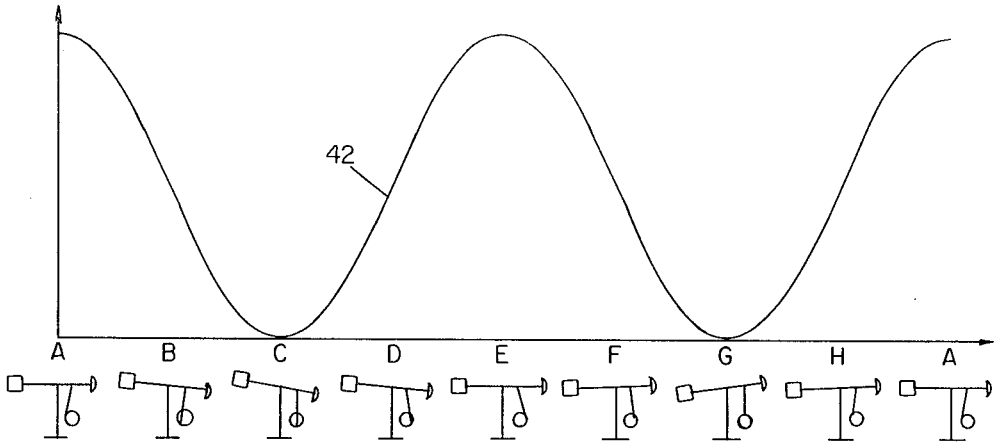

FIG. 3 is a graph of power demand during a complete jackpump cycle (ordinate) against time (abscissa), and includes diagrammatic drawings of jackpump positions at various lettered points in time.

Figure 4:
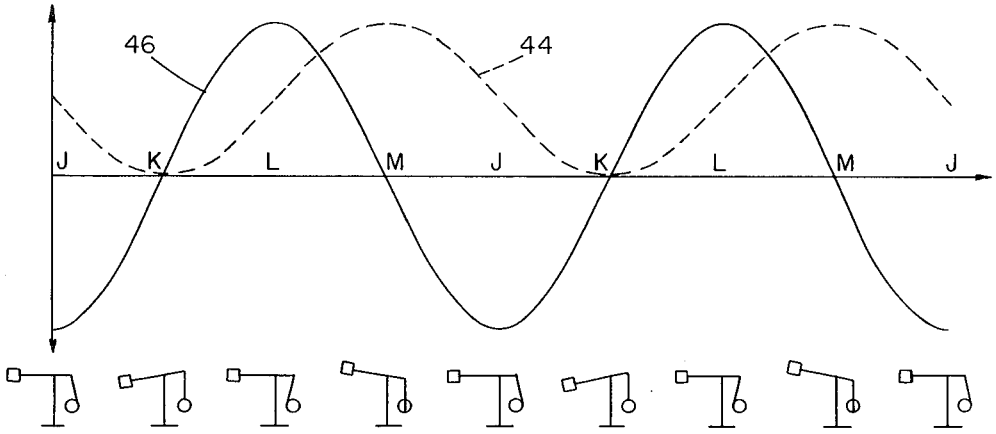

FIG. 4 includes in a solid line a graph of power flow into the storage means of the most preferred embodiment (ordinate) plotted against time (abscissa); and, in dotted lines, the amount of stored energy (ordinate) plotted against time (abscissa); sketches of the weight storage means at the various lettered points in time are included.

Figure 5:
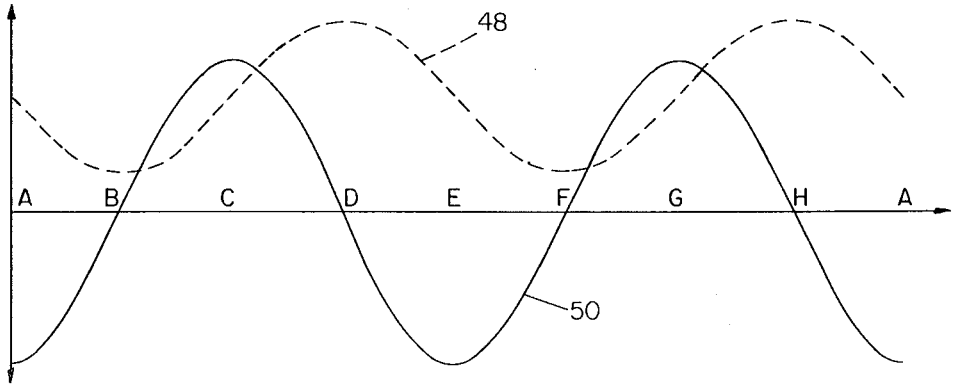

FIG. 5 relates to the fly wheel preferred embodiment, and shows in a solid line power flow into the storage means (ordinate) versus time (abscissa) and in a dotted line energy stored (ordinate) against time (abscissa).

STRUCTURE

Turning now to FIGS. 1 and 2, there is shown a solar array 10 electrically connected directly to motor 12 for driving a jack pump, indicated generally at 14. Valve 16 closes on an upstroke to lift a column of liquid, valve 18 at the same time opening to admit more. Counterweight 20 serves to make the peak load the same on both an upstroke and a downstroke (i.e., half the weight of the column being lifted by the pump).

Beam 22 of jackpump 14 is oscillated through connecting rod 24 by toothed pulley 26 driven through speed reducer 28 by motor 12.

Weight 30, oscillated through beam 32 by toothed pulley 34 driven from toothed pulley 26 through toothed belt 36, serves as a mechanical accumulator according to the invention to smooth out, in relation to time, power being supplied to the jackpump.

Pulley 34 rotates twice for every rotation of pulley 26, and the two pulleys are related in time as set forth in FIGS. 3 and 4, in which corresponding moments in time are vertically superimposed.

Another preferred embodiment is illustrated in FIG. 2A, and comprises a fly wheel 38 driven from input shaft 40.

OPERATION

Operation of the most preferred embodiment is illustrated in FIGS. 3 and 4. As will be noted, when jackpump 14's power requirement is at its greatest, as shown on curve 42, at A and E, storage energy released from weight 30 is greatest (at J). Energy stored in weight 30 is illustrated in graph 44, and as will be seen, minimum storage (at K) corresponds with the point at which the flow into storage (graph 46) begins again, just as maximum storage occurs (at M) as energy flow into storage breaks into a negative figure.

Similar relationships can be noted between energy storage curve 48 and energy input curve 50 in FIG. 5. The curves are somewhat diagrammatic, in amplitudes. For example, in a ¾ horsepower system using a fly wheel about a foot in diameter and about 25 lbs. in weight, with an average rpm of 1900, angular velocity varied only 1 to 2 percent to accomplish the accumulation and smoothing function, for a variation in energy stored at any one time (curve 48) of only about 4 percent.

The curves as drawn in our application are somewhat approximated. Ideally, input energy could be maintained completely constant; however, in practice, it varies about 5 to 10 percent.

These arrangements considerably decrease the size of array needed to drive a device of any given power requirement, without necessitating the expense and difficulty of batteries.

RELATION TO OTHER DISCLOSURES

A maximum-power-point-tracking circuit, to maximize the amount of power transferred from the array to the pump, is the invention of the undersigned Ronald William Matlin, and is the subject of patent application Ser. No. 256,730 filed Apr. 23, 1981, now abandoned, the contents of said Matlin application being hereby incorporated herein by reference.

What is claimed is:

1. In combination:

a solar array including a plurality of cells, each said cell directly producing electricity, said array producing a power output proportional to sunlight intensity, a device electrically powered by said solar array, said device consuming power in fluctuating amounts and operating in a fluctuating cyclical manner, and mechanical energy accumulator means, said accumulator means cooperating with said device for storage of energy when energy requirements of said device are smaller and delivering energy to said device to supplement energy from said array when energy requirements of said device are higher.

2. The combination of claim 1 in which said mechanical energy accumulator means is a weight.

3. The combination of claim 2 in which said device is a pump, said mechanical accumulator is electrically powered by an electrical motor, and said mechanical accumulator includes a pump drive toothed pulley and an energy storage weight drive toothed pulley driven by said electrical motor, said pump drive toothed pulley being connected to drive said pump and to be driven by, and to rotate once for every two rotations of, said energy storage weight drive toothed pulley.

4. The combination of claim 1 in which said mechanical energy accumulator means is a fly wheel.

5. The combination of claim 1 in which said mechanical energy accumulator means delivers energy to said device during each half-cycle of said device.

* * * * *